US010550619B2

(12) United States Patent
Caffrey et al.

(10) Patent No.: US 10,550,619 B2
(45) Date of Patent: Feb. 4, 2020

(54) SHOWER DOOR HINGE MECHANISM

(71) Applicant: Coram UK Holding Limited, Bridgnorth (GB)

(72) Inventors: Matthew Caffrey, Shrewsbury (GB); Marshall Young, Much Wenlock (GB); Robert Alan Jarvis, Wellington (GB)

(73) Assignee: Coram UK Holding Limited, Shropshire (GB)

( * ) Notice: Subject to any disclaimer, the term of this patent is extended or adjusted under 35 U.S.C. 154(b) by 166 days.

(21) Appl. No.: 15/300,252

(22) PCT Filed: Mar. 30, 2015

(86) PCT No.: PCT/EP2015/056932
§ 371 (c)(1),
(2) Date: Sep. 28, 2016

(87) PCT Pub. No.: WO2015/144940
PCT Pub. Date: Oct. 1, 2015

(65) Prior Publication Data

US 2017/0183900 A1 Jun. 29, 2017

(30) Foreign Application Priority Data

Mar. 28, 2014 (GB) ..... 1405578.4

(51) Int. Cl.
*E05F 7/02* (2006.01)
*A47K 3/36* (2006.01)
(Continued)

(52) U.S. Cl.
CPC ..... *E05F 7/02* (2013.01); *A47K 3/36* (2013.01); *E05D 3/02* (2013.01); *E05D 11/00* (2013.01);
(Continued)

(58) Field of Classification Search
CPC .... E05F 7/02; E05F 11/54; E05F 1/06; A47K 3/36; E05D 3/02; E05D 11/00; E05D 11/1014
(Continued)

(56) References Cited

U.S. PATENT DOCUMENTS 1,416,651 A 5/1922 Lanfair
4,802,247 A 2/1989 Leichle
(Continued)

FOREIGN PATENT DOCUMENTS

CH 0573316 3/1976
DE 199 46 138 A1 4/2001
(Continued)

OTHER PUBLICATIONS

Office Action for Corresponding European Patent No. 15 715 203.4, dated Dec. 13, 2017.
(Continued)

*Primary Examiner* — Tuan N Nguyen
(74) *Attorney, Agent, or Firm* — Hauptman Ham, LLP

(57) ABSTRACT

A shower door hinge mechanism (201) for a half-height shower door, operable to lift the shower door (203) to remove any contact between the bottom seal element (209) and the shower floor area (203). The hinge mechanism (201) comprises first and second co-operable hinge parts (204, 205) mountable to a shower door (203), and a manually-operable element (206) engageable with at least one of the first and second parts (204, 205) such that operating the manually-operable element (206) causes one of the first and second parts (204, 205) to be moved into a raised position relative to the other. Shower door apparatus (202) comprising the hinge mechanism (201), and a shower door installation (301) comprising the shower door apparatus (202). A method of enabling a shower door (203) to be lifted to
(Continued)

enable rotation of the shower door (203) free of contact with the shower area floor.

16 Claims, 10 Drawing Sheets

(51) Int. Cl.

| | |
|---|---|
| ***E05D 11/10*** | (2006.01) |
| ***E05D 3/02*** | (2006.01) |
| ***E05D 11/00*** | (2006.01) |
| ***E05F 1/06*** | (2006.01) |
| ***E05F 11/54*** | (2006.01) |

(52) U.S. Cl.
CPC ..... *E05D 11/1014* (2013.01); *E05F 1/06* (2013.01); *E05F 11/54* (2013.01); *A47K 2003/365* (2013.01); *A47K 2003/367* (2013.01); *E05Y 2900/114* (2013.01)

(58) Field of Classification Search
USPC ..... 4/607, 556
See application file for complete search history.

(56) References Cited

U.S. PATENT DOCUMENTS

| | | | | |
|---|---|---|---|---|
| 6,766,543 | B1 * | 7/2004 | Hollis | A47K 3/006 4/556 |
| 2010/0293861 | A1 * | 11/2010 | Ting | E05B 47/026 49/394 |

FOREIGN PATENT DOCUMENTS

| | | | | |
|---|---|---|---|---|
| DE | 202009012205 | U1 | 2/2011 | |
| EP | 0 553 466 | A1 | 8/1993 | |
| EP | 0553466 | A1 | 8/1993 | |
| EP | 0933052 | A2 | 8/1999 | |
| EP | 2639390 | A1 | 9/2013 | |
| FR | 2229372 | | 12/1974 | |
| FR | 2388117 | | 11/1978 | |
| GB | 1474081 | | 5/1977 | |
| GB | 2352393 | A * | 1/2001 | A47K 3/006 |

OTHER PUBLICATIONS

International Patent Application No. PCT/EP2015/058932, Search Report and Written Opinion dated Jun. 22, 2015, 9 pgs.
United Kingdom Patent Application No. GB1405578.4, Search Report dated Aug. 21, 2014, 7 pgs.

* cited by examiner

SHOWER DOOR HINGE MECHANISM

CLAIM OF PRIORITY

This application is a U.S. National Stage Filing under 35 U.S.C. 371 from International Application No. PCT/EP2015/056932, filed on Mar. 30, 2015, and published as WO 2015/144940 A1 on Oct. 1, 2015, which claims the benefit of priority to United Kingdom Patent Application No. 1405578.4, filed on Mar. 24, 2014, each of which is hereby incorporated by reference herein in its entirety.

TECHNICAL FIELD

Aspects relate, in general, to a shower door hinge mechanism, and more particularly, although not exclusively, to a shower door hinge mechanism for lifting a shower door of a shower installation.

BACKGROUND

Various types of shower door are known, which include sliding shower doors, bi-fold shower doors, hinged shower doors and pivot shower doors. A shower door may be used with a shower tray or in a wet room, and typically extends from the floor upwards. Although different sizes of shower door are available, they are usually classed as either full-height (for example in the range 1850 mm-1950 mm), which may be used in an installation in a standard bathroom, reduced height (for example 1750 mm), which may be used in an installation in a loft or cellar, or half-height (for example 750 mm-900 mm), which may be used in an installation for a person with reduced mobility for example.

A known type of installation for a person with reduced mobility includes a half-height hinged shower door with a seal element at the bottom that contacts the shower area floor to prevent leakage when the shower is in use. Contact between the seal element and the shower area floor can prevent the shower door from pivoting freely. Friction arising from contact between the seal element and the shower area floor can cause resistance to rotation, inhibit smooth opening and closing of the shower door, and cause the seal element to be dragged along the shower area floor as the shower door is swung open and closed. Consequently, easy operation of the shower door is impeded and the seal element can become damaged leading to unwanted seepage or leakage of water from underneath the shower door to the outside of the shower area. Thus, contact between the shower door and the shower area floor during rotation of the shower door makes the shower door difficult to move and impairs the reliability and working life of the seal element.

A first known proposed solution involves the use of a rising butt hinge as the lower pivot hinge of the half-height shower door, which is arranged such that the shower door rises upwards as it is opened. However, with this arrangement, the seal element is brought into contact with the shower area floor before the shower door is fully closed and is not lifted clear of the shower area floor until the shower door has been partly opened. This issue is more prominent when a compressible bottom seal element is used on the shower door. As the shower door is brought into the fully closed position, the compressible seal element is squashed against the shower area floor, resulting in resistance to rotation of the shower door. Further, rise gained during opening of the shower door is not directly translated to lift of the lower edge of the compressible seal element above the shower area floor until the seal element has returned to its uncompressed state. Thus, this first proposed solution does not fully address the problem of contact between the bottom seal element of the shower door and the shower area floor during opening and closing of the shower door.

A second known proposed solution utilises a lever-activated gas strut, which is arranged to lift the half-height shower door upon manual operation of the lever. In the arrangement of this second proposed solution, the shower door is subsequently lowered by pushing the shower door vertically back down, to a position at which the shower door is then held in the lowered position until the lever is again operated. However, the required pushing action to lower the shower door is difficult for some users of impaired mobility, in particular for users who are in a seated position when applying a downward force onto the shower door such as those using a wheelchair.

It is therefore desirable for the seal element to be clear of the shower area floor before the shower door is rotated, and for the shower door to be easy for persons with reduced mobility to open and close.

SUMMARY

According to an aspect there is provided a hinge mechanism for a half-height shower door, said hinge mechanism comprising first and second co-operable hinge parts mountable to a shower door, and a manually-operable element engageable with at least one of said first and second parts of said hinge mechanism such that operating said manually-operable element causes one of the first and second parts of said hinge mechanism to be moved into a raised position relative to the other of the first and second parts of said hinge mechanism, whereby, in use, operating said manually-operable element causes said shower door to be lifted.

In an embodiment, the second part of the hinge mechanism comprises a pin member rotatable within the first part of the hinge mechanism, and the manually-operable element comprises a rotatable handle element engageable with the second part of said hinge mechanism such that rotating the rotatable handle element rotates the pin member of the second part of the hinge mechanism within the first part of the hinge mechanism and causes the first part of the hinge mechanism to be moved into a raised position relative to the second part of the hinge mechanism, whereby, in use, rotating the rotatable handle element causes the shower door to be lifted.

According to a further aspect, there is provided shower door apparatus comprising a shower door provided with a bottom seal element, and a shower hinge mechanism according to an aspect.

In an embodiment, the shower door is a half-height shower door provided with upper and lower pivot hinges, and the upper pivot hinge is provided by the shower door hinge mechanism. In an embodiment, the lower pivot hinge is provided by a rising butt hinge.

According to a further aspect there is provided a shower door installation comprising shower door apparatus according to an aspect, assembled for use. In an application, the shower door installation is installed in a wet room.

According to a further aspect there is provided a method of enabling a shower door to be lifted to enable rotation of the shower door free of contact with the shower area floor, the method comprising the step of providing the shower door with a shower door hinge mechanism according to an aspect.

The shower door hinge mechanism enables the shower door to be lifted to remove any contact between the bottom seal element of the shower door and the shower floor area so that the shower door can be freely rotated into, and from, the closed rotational position of the shower door. The shower door hinge mechanism allows the shower door to be rotated into the closed rotational position and then lowered, and raised and then rotated into an open rotational position.

According to a further aspect, there is provided a hinge mechanism for a half-height shower door, said hinge mechanism comprising first and second co-operable hinge parts mountable to a shower door, and a manually-operable element engageable with at least one of said first and second parts of said hinge mechanism such that operating said manually-operable element causes one of the first and second parts of said hinge mechanism to be moved into a lowered position relative to the other of the first and second parts of said hinge mechanism, whereby, in use, operating said manually-operable element causes said shower door to be lowered.

The first and second parts can include a cooperating notch and protrusion respectively, whereby to cause the handle to hold in a closed configuration when the notch and protrusion are brought together so that the protrusion rests in the notch.

According to a further aspect, there is provided a shower door apparatus comprising a shower door provided with a bottom seal element, and a shower hinge mechanism as described herein, in which the hinge mechanism is an upper hinge mechanism, the apparatus further comprising a lower hinge mechanism including a spring element so arranged as to bias the door apparatus in an upwards direction against the action of the upper hinge mechanism. The upper hinge mechanism can be a rising butt hinge mechanism operable, upon rotation of a handle from a closed to an open configuration, to cause the door apparatus to move in a downwards direction against the action of the spring.

Accordingly, a shower door apparatus can be biased in an upwards direction using a spring mounted in cooperation with a lower hinge. The door can be temporarily fixed in a lowered position using the handle in a closed configuration. When the handle is rotated to an open configuration, the hinge mechanism of the upper hinge can be arranged to enable the spring to raise the door apparatus clear of the floor.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

BRIEF DESCRIPTION OF THE DRAWINGS

The present invention will now be more particularly described, by way of example only, with reference to the accompanying drawings, in which.

DESCRIPTION

Figure 1:
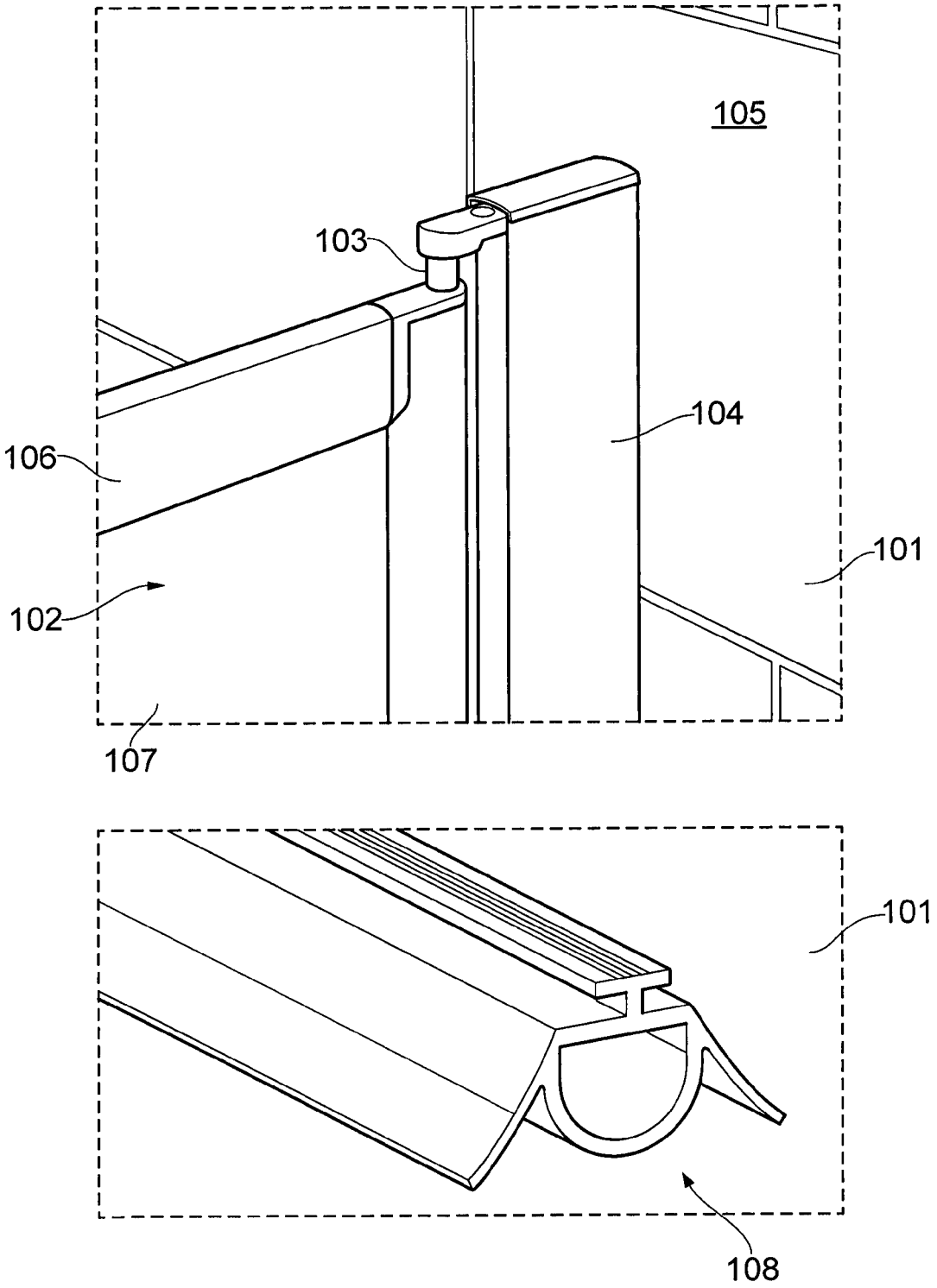
FIG. 1 (Prior Art)
FIG. 1 shows features of prior art shower door apparatus.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Features of a prior art shower door apparatus are shown in FIG. 1. The prior art shower door apparatus 101 comprises a shower door 102 provided with an upper pivot hinge 103 and a lower pivot hinge (not shown). The pivot hinges are mounted to a support 104, which in turn is fixed to a wall 105. The shower door 102 comprises a frame 106 that supports a shower door panel 107. The shower door 102 is arranged to be swung between open and closed positions.

The bottom of the shower door 102 is provided with a seal element 108, which contacts the shower floor to prevent the escape of water from the shower. Contact between the seal element 108 and the floor causes resistance to rotation and hinders easy operation of the shower door 102. Furthermore, contact between the seal element 108 and the floor causes the seal element 108 to be dragged along the shower area floor as the shower door is swung open and closed and can lead to the seal element 108 becoming damaged, resulting in undesirable leakage of water.

Figure 2:
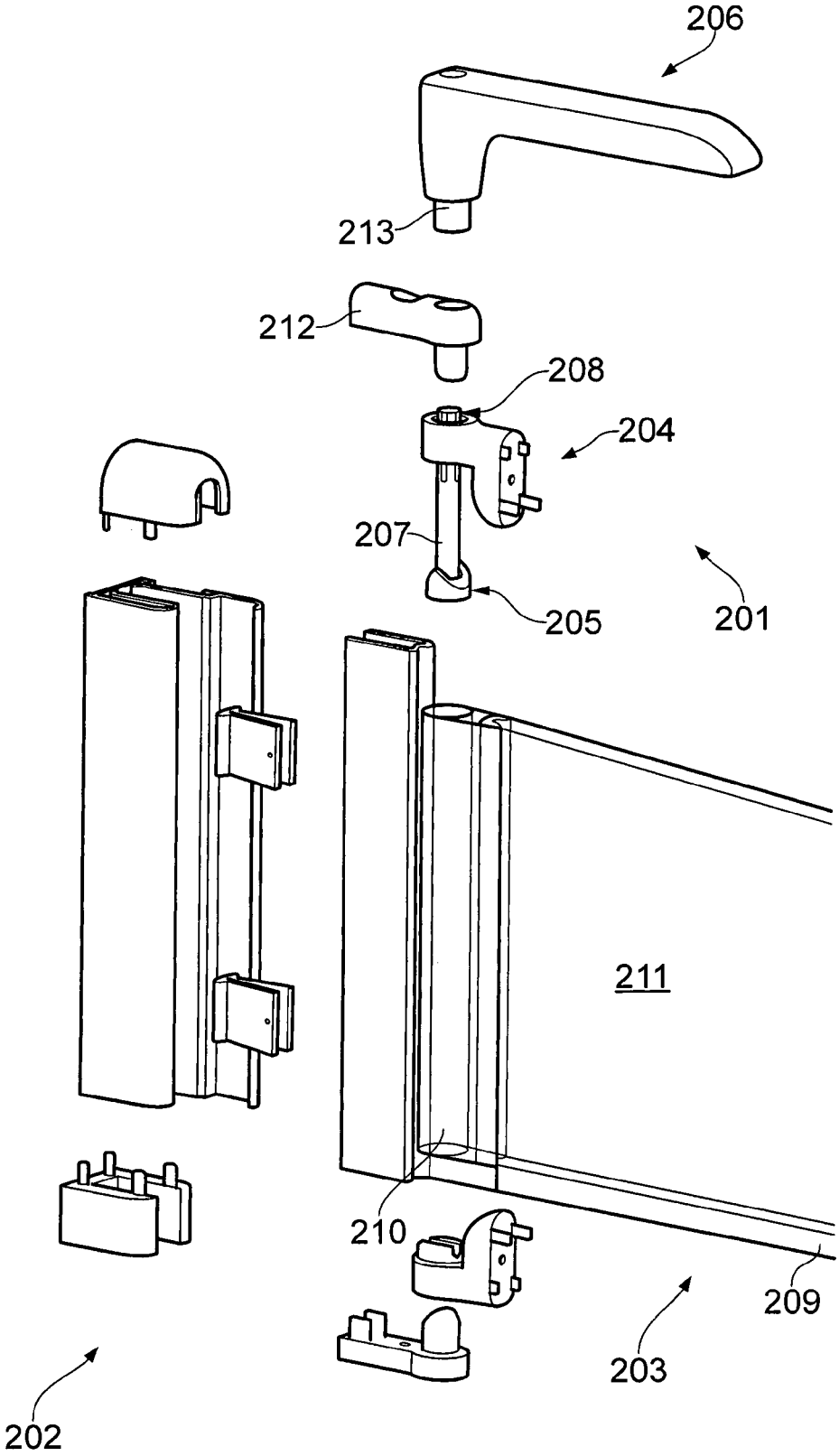
FIG. 2 shows an exploded view of shower door apparatus comprising a hinge mechanism according to an example.
Figure 3:
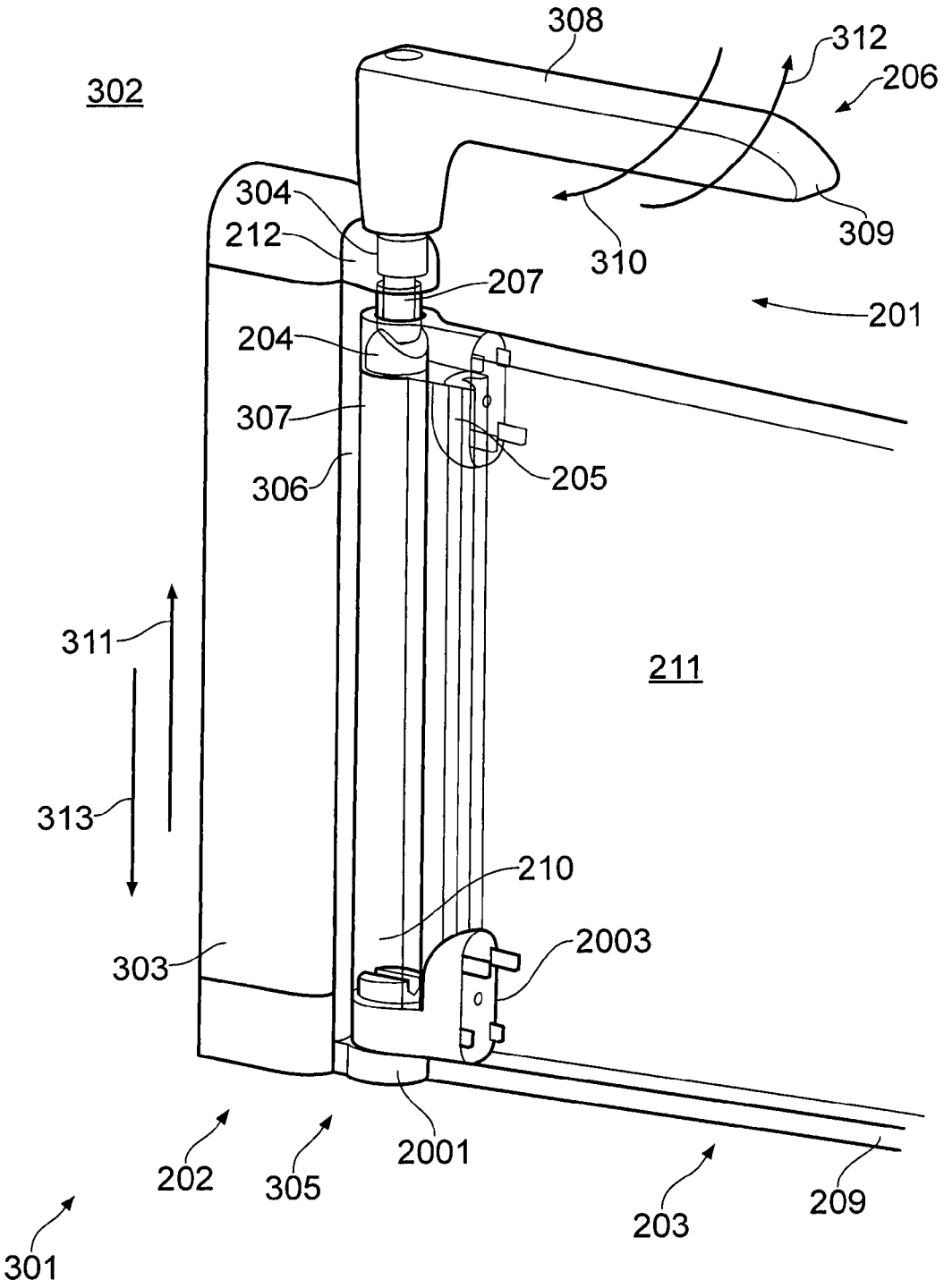
FIG. 3 shows a shower door installation comprising the shower door apparatus comprising a hinge mechanism as shown in FIG. 2 according to an example.

A shower door hinge mechanism 201 according to an example is illustrated in FIGS. 2 and 3. FIG. 2 shows an exploded view of shower door apparatus 202 comprising the hinge mechanism 201, and FIG. 3 shows the shower door apparatus 202 comprising the hinge mechanism 201 assembled within a shower door installation 301.

The shower door hinge mechanism comprises first and second co-operable hinge parts mountable to a shower door, and a manually-operable element engageable with at least one of the first and second parts of the hinge mechanism such that operating the manually-operable element causes one part of the first and second parts of the hinge mechanism to be moved into a raised position relative to the other of the first and second parts of the hinge mechanism, whereby, in use, operating the manually-operable element causes the shower door to be lifted.

Hinge mechanism 201 is suitable for use with a half-height shower door 203, as shown in FIGS. 2 and 3. This type of door is used in shower installations for persons with reduced mobility for example, such as a shower installation in a wet room for a wheelchair user. The hinge mechanism 201 provides a lifting hinge mechanism for the shower door 203.

As can be seen most clearly in FIG. 2, in the illustrated embodiment, hinge mechanism 201 comprises first and second co-operable hinge parts 204, 205 and a rotatable handle element 206. The first part and second parts 204, 205 of the hinge mechanism 201 are each mountable to the shower door 203. The second part 205 of the hinge mechanism 201 comprises a pin member 207 that is rotatable within the first part 204 of the hinge mechanism 201. According to this illustrated arrangement, the first part 204 defines an aperture 208 and the pin member 207 of the second part 205 is rotatable within the aperture 208 of the first part 204. As can be seen in FIG. 3, in use, the pin member 207 of the second part 205 extends through the aperture 208 of, and projects upwardly from, the first part 204.

The rotatable handle element 206 is engageable with the second part 205 of the hinge mechanism 201 such that rotating the rotatable handle element 206 in a first direction rotates the pin member 207 of the second part 205 of the hinge mechanism 201 within the first part 204 of the hinge mechanism 201 and causes the first part 204 of the hinge mechanism 201 to move into a raised position relative to the second part 205. In this embodiment, rotating the rotatable handle element 206 in a second, opposite direction rotates the pin member 207 of the second part 205 of the hinge mechanism 201 within the first part 204 of the hinge mechanism 201 and causes the first part 204 of the hinge mechanism 201 to move into a lowered position relative to the second part 205.

The first and second parts 204, 205 of the hinge mechanism 201 are shown mounted to the shower door 203 in FIG. 3. According to the shown arrangement, when the rotatable handle element is operated, the first part 204 moves upwards along the pin member 207 of the second part 205, causing the shower door 203 to be moved upwards.

In an example, the first and second parts 204, 205 of the hinge mechanism 201 are in the form of a rising butt hinge mechanism. As can be seen in FIG. 2 for example, second part 205 includes two inclined or ramped surfaces, although it will be appreciated that only one such surface may be provided, which may extend around the base of the pin member 207 thereby forming a single ramp. First part 204 includes corresponding ramp portions inside (and therefore not visible in FIG. 2) that are so profiled as to engage with the ramped surfaces of second part 205.

As typical with such rising butt type mechanisms, the two parts sit together with their respective ramped surfaces flush to one another, and relative movement of one part against the other causes the surfaces to move relative to one another thereby provoking rotational and translational movement of the hinge mechanism. In the example of FIG. 2, as the handle 206 is turned, the second part 205 moves relative to the first part 204 causing translation of the first part 204 up (or down). Frictional forces experienced by the door 203 where it engages the floor and/or between frame element 210 and a door rotation inhibiting means (as will be described in more detail below) cause translation of the hinge mechanism to occur.

The shower door 203 comprises a bottom seal element 209, and as the shower door 203 is lifted, the seal element 209 is also lifted. Operating the hinge mechanism 201 thus lifts the seal element 209 upwards, to raise the seal element 209 clear of the shower area floor. The shower door 203 may then be opened or closed without the seal element 209 being in contact with the shower area floor. By removing all contact between the seal element 209 and the surface that the seal element 209 abuts against to provide a waterproof seal to prevent leakage when the shower is in use, effortless and smooth opening and closing of the shower door 203 is facilitated and the risk of the seal element 209 being damaged is reduced. According to the illustrated arrangement of FIG. 3, turning the rotatable handle element 206 causes the shower door 203 to be lifted, to improve the opening and closing actions of the shower door 203.

In operation, the hinge mechanism 201 lifts the shower door 203 to raise the seal element 209 above the shower floor surface in preparation for the shower door 203 being manually pivoted open or closed with the seal element 209 free of any contact surface. Preferably, and in this embodiment, the seal element 209 is a compressible seal element. In a specific arrangement, the compressible seal element is of the same type as seal element 108 shown in FIG. 1, which comprises a central, hollow compressible part with a flap to each side. As the shower door 203 is lowered, the central hollow compressible part is squashed against a contact surface to create a waterproof seal, and as the shower door 203 is raised the hollow compressible part returns to its uncompressed state.

In this illustrated embodiment, the shower door 203 comprises a frame element 210 that supports a shower door panel 211, and the first and second parts 204, 205 of the hinge mechanism 201 are mounted to the frame element 210 of the shower door 203. In this illustrated example, frame element 210 is arranged to extend along the inner edge of opposed depth-direction edges of the shower door panel, extending vertically in use. In an alternative example, the frame element is arranged to extend along the upper of opposed width-direction (horizontal) edges of the shower door panel, extend horizontally in use. It is to be appreciated that the frame element 210 may be the only frame element the shower door is provided with, or be part of a semi-frame or full frame of the shower door. Alternatively, the hinge mechanism 201 may be used with a frameless type shower door.

According to an embodiment, the shower door apparatus 202 comprises a guide element 212 that is locatable around the pin member 207 of the second part 205 of the hinge mechanism 201, and into which a base part 213 of the rotatable handle element 206 extends and within which the base part 213 is rotatable.

The shower door 203 may be hinged, directly or indirectly to, to a support post or a wall. In FIG. 3, the shower door 203 is shown fixed to wall 302 by support member 303.

As illustrated in FIG. 3, the shower door 203 is provided with upper and lower pivots 304, 305 respectively, and the upper pivot 304 is provided by the hinge mechanism 201. Preferably, and in this embodiment, the lower pivot 305 is provided by a rising butt hinge. This is arranged such that, if the hinge mechanism 201 is not operated by a user, the shower door 203 will be lifted by the function of the rising butt hinge of the lower pivot 304 as the shower door 203 is swung open from the closed position. For example, lower hinge part 2001 can include a ramp portion, and lower hinge part 2003 can include an appropriately profiled inner ramp follower portion such that as relative movement of the parts occurs the lower hinge part 2003 is translated up (or down) relative to lower hinge part 2001, which can be fixed to or in the support member 303 for example.

In an alternative embodiment, the lower pivot 305 is provided by a simple pivot pin arrangement.

In an embodiment, the shower door apparatus comprises door rotation inhibiting means for inhibiting rotation of the shower door during operation of the hinge mechanism to lift the shower door. In the example of FIG. 3, shower door apparatus 202 comprises door rotation inhibiting means in the form of a seal member 306 between the inside edge 307 of the shower door 203 and the support member 303. The inhibition means may be fixed to the inside edge 307 of the shower door 203 or to the support member 303. The inhibition means acts in addition to initial resistance to rotation provided by the friction between the bottom seal element 209 and the shower area floor, whereby to provoke translational movement of the door apparatus 202 up or down as the handle 206 is turned so as to lift the door apparatus clear of the floor so that it can be opened (or closed) without causing damage to a floor seal and making it easier to open (close) the door. That is, as the handle 206 is turned, friction between the door rotation inhibiting means and either the inside edge 307 of the shower door 203 or the support member 303 depending to which part of the apparatus the inhibiting means is attached, inhibits rotational movement of the door apparatus 202 thereby enabling turning of handle 206 to cause the door apparatus 202 to rise or fall by virtue of the hinge mechanism 201.

As shown in FIG. 3, the rotatable handle element 206 can comprise an elongate grippable/graspable portion 308 with a free end 309. In an example, the hinge mechanism 201 is arranged such that, when the shower door 203 is closed, the elongate grippable portion 308 of the rotatable handle element 206 extends in substantially the same direction as the shower door 203. It is to be appreciated however that the relative position between the elongate grippable portion 308 of the rotatable handle element 206 and the shower door 203 when the shower door is in the closed position may vary. For example, the elongate grippable portion 308 of the rotatable handle element 206 may extend substantially perpendicularly to the direction of the shower door 203 when the shower door 203 is closed. In the shown shower installation, the guide element 212 is mounted in fixed relation to the support member 303, and acts to stabilise the rotatable handle element 206 during operation.

With reference to FIG. 3, rotating the rotatable handle element 206 operates the hinge mechanism 201 to lift the shower door 203 upwards, in the direction indicated by arrow 311, and rotating the rotatable handle element 206 in the opposite direction of rotation operates the hinge mechanism 201 to lower the shower door 203 in the downward direction indicated by arrow 313.

In an example, rotating the rotatable handle element 206 in a first direction of rotation, indicated by arrow 310, operates the hinge mechanism 201 to lift the shower door 203 upwards, in the direction indicated by arrow 311, and rotating the rotatable handle element 206 in the second, opposite direction of rotation, indicated by arrow 312, operates the hinge mechanism 201 to lower the shower door 203 in the downward direction indicated by arrow 313. It will be appreciated that rotation of the handle in either direction may result in rise or fall of the door 203.

In an embodiment, the hinge mechanism 201 is operable to raise the shower door 203 by approximately 10 mm. It is to be appreciated however that the magnitude of rise of the shower door effected by operation of the hinge mechanism 201 may vary and may be selected depending, for example, on the installation environment. As such, a larger or smaller rise magnitude may be selected, and there may therefore be multiple different hinge mechanisms with respective different rise magnitudes that may be selected. For example, the first and second hinge parts 204, 205 can be provided with multiple different inclinations and/or ramp sizes, whereby to effect different rise magnitudes. According to an embodiment, the rotatable handle element 206 of the hinge mechanism 201 is rotatable through a travel of approximately 90 degrees rotation to lift the shower door 203 from a most lowered condition into a most raised position condition. For example, the rotatable handle element 206 is rotatable from a position in which it extends in substantially the same direction as the lowered, closed shower door 203 into a position in which it extends substantially perpendicularly to the raised shower door 203. In an alternative arrangement, the rotatable handle element 206 is rotatable from a position in which it extends in substantially perpendicularly to the direction of the lowered, closed shower door 203 into a position in which it extends in substantially the same direction as the raised shower door 203. In the raised position, the shower door can be manually opened by rotating the door about the hinge 305, 201.

It is to be appreciated that the rotatable handle element 206 may be rotated through a maximum travel of approximately 90 degrees rotation (for example, so that it can be turned only one of clockwise and anti-clockwise to effect lifting of the shower door) or a maximum travel of approximately 180 degrees rotation (for example, so that it can be turned either clockwise or anti-clockwise to effect lifting of the shower door). It is to be understood that the degree rotation of the travel of the rotatable handle element 206 of the hinge mechanism 201 to effect full lifting and lowering of the shower door 203, and the degree rotation of the maximum travel of the rotatable handle element 206 may vary.

Figure 4:
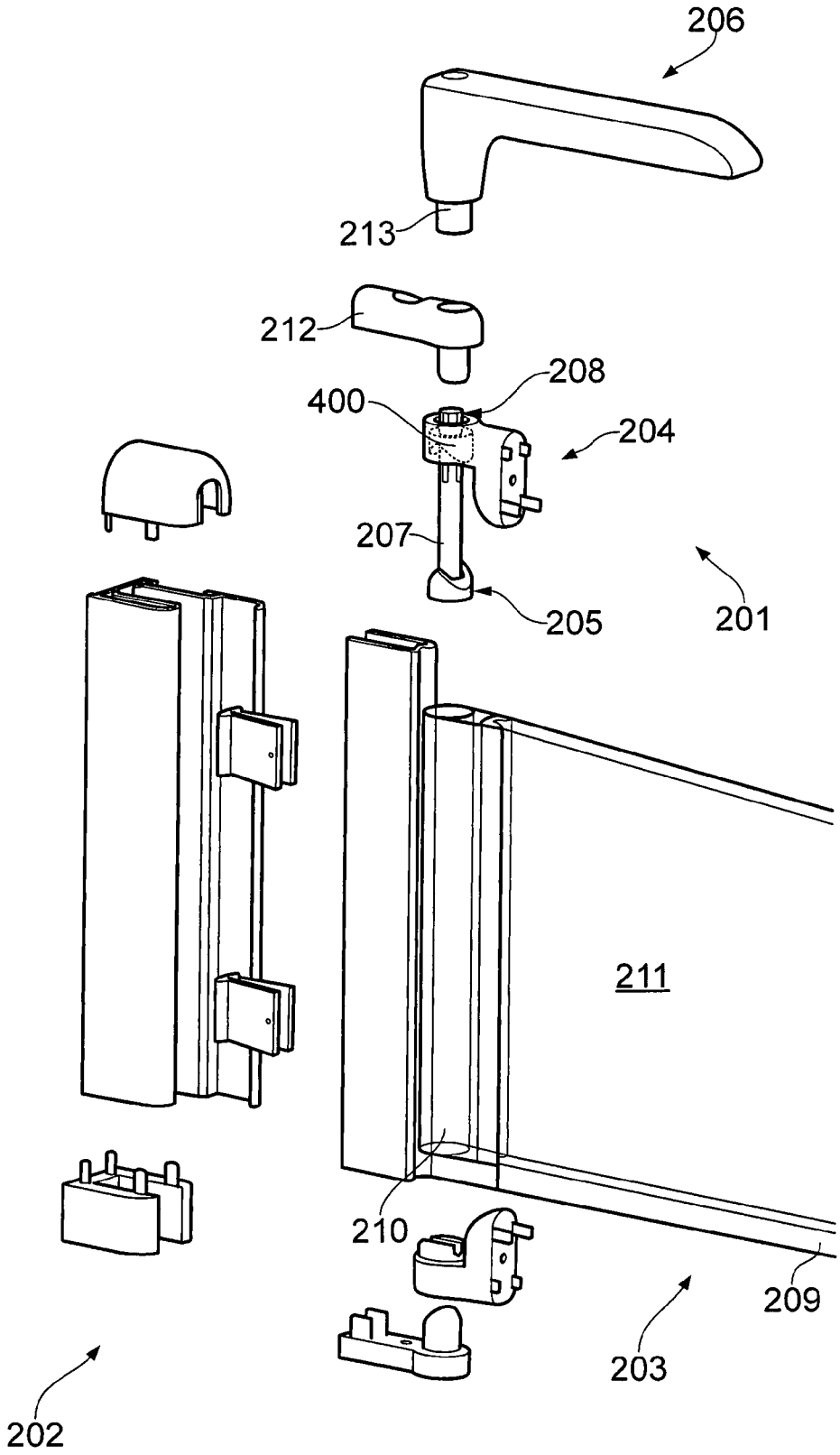
FIG. 4 shows a shower door installation comprising the shower door apparatus comprising a hinge mechanism according to an example.

FIG. 4 shows a shower door installation comprising the shower door apparatus comprising a hinge mechanism according to an example. As can be seen in FIG. 4, the inner profile 400 of part of the upper portion of the hinge part 204 is depicted. As can be seen, the inner profile is such to engage with the part 205 in order to form a rising butt hinge mechanism, such that parts cooperate with one another so as to cause translational movement of the door 211 upon rotation of one part relative to the other. That is, as handle 206 is rotated, the part 205 on pin 207 moves relative to fixed part 400 thereby provoking a translation movement, up or down, depending on the handle position.

The hinge mechanism and/or the shower door apparatus can include position holding means for selectively holding one or more positions of the rotatable handle element. For example, the position holding means may be configured to hold the rotatable handle element in the position it is in when the shower door is fully opened. This serves to prevent undesired closing of the shower door as a person is entering or leaving the showering area. In an embodiment, holding means in the form of a notch, such as a 'V-shaped' notch, is provided for retaining the rotatable handle element in the rotational position it is in when the shower door is fully opened and raised.

Preferably, the hinge mechanism and/or the shower door apparatus comprises shower door condition indicating means for indicating whether the shower door is in a lowered condition or in a raised condition. The shower door condition indicating means may take any suitable form. In an embodiment, a window is presented in which an indicator is visible, the indicator changing display as the shower door is opened (raised) and closed (lowered). The indicator display may include one or more different colours, text and graphics associated with the different heights of the shower door. For example, a transparent window or opening may be provided in the first hinge part 204. An indicator can be provided on the shaft of the pin member 207, which may be a coloured portion for example. As the handle is rotated, and the first hinge part 204 rises relative to the pin member 207, the indicator on the shaft can be positioned thereon so as to come into view through the window or opening on the part 204. A similar arrangement can be provided in connection with part 212 for example.

The described shower door hinge mechanism thus enables the shower door to be lifted to remove contact between the bottom seal element of the shower door and the shower floor area so that the shower door can be freely rotated into, and from, the closed rotational position of the shower door. The shower door hinge mechanism allows the shower door to be rotated into the closed rotational position and then lowered, and raised and then rotated into an open rotational position.

Components of the hinge mechanism and the shower door apparatus as described herein may comprise one or more pieces, be fabricated from any suitable material or combination of materials, and may be manufactured using any suitable process or combination of processes. The hinge mechanism may be fabricated from one or more metal and/or plastics materials. With reference to the embodiment illustrated in FIGS. 2 and 3, the pin member of the second part of the hinge mechanism may comprise a metal pin. Processes such as moulding and die casting may be used. The shower door panel may be fabricated from a glass or a plastics material, or any other suitable material, and may be opaque, semi-transparent or transparent. The seal element may be fabricated from a rubber material. Components of the hinge mechanism and the shower door apparatus may be connected to any other piece or component in any suitable way.

It is to be appreciated that the shower door hinge mechanism may have any form suitable to provide the described functionality. In an embodiment, the hinge mechanism comprises a rising butt hinge arrangement as described above, in which the first and second parts of the hinge 201 comprise respective ramps/ramp follower portion or portions to effect translation/movement of the door up/down. In an alternative embodiment, the hinge mechanism can comprise a lever and cam arrangement.

Figure 5:
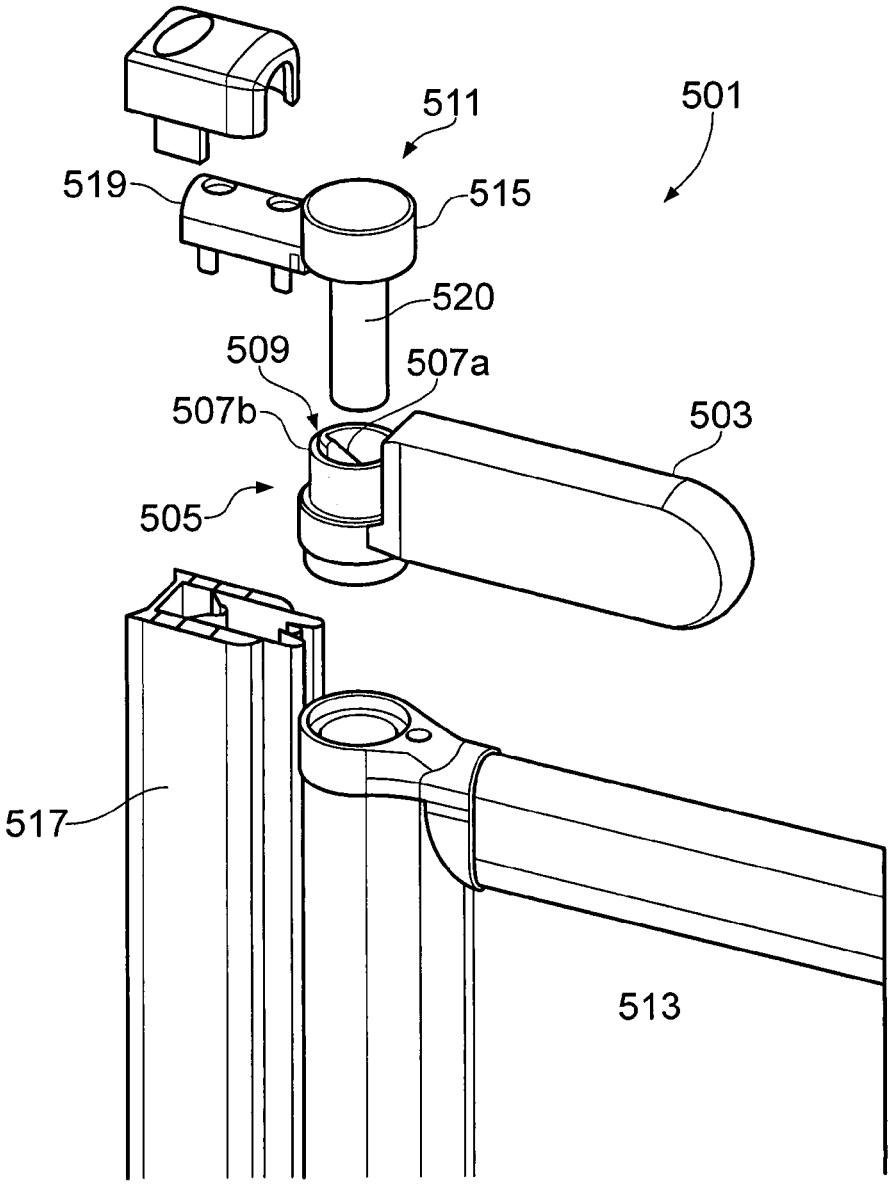
FIG. 5 is an exploded view of a hinge mechanism of a shower door apparatus according to an example.

FIG. 5 is an exploded view of a hinge mechanism of a shower door apparatus according to an example. An upper hinge portion 501 of a shower door apparatus is shown in FIG. 5, along with a handle 503. Handle portion 503 includes a lower part 505 of a rising butt hinge mechanism for the hinge portion 501. The hinge mechanism of the example shown in FIG. 5 is a reverse rising butt hinge. The hinge mechanism operates to effectively force the door 513 downwards by virtue of the placement of the fixed and the movable parts of the hinge mechanism. That is, upon rotation of handle 503 from an open configuration to a closed configuration, the door hinge mechanism causes the door to be forced downwards for reasons that will be described in more detail below.

As can be seen in FIG. 5, the inner profile of part 505 consists of a pair of generally diverging and downwardly travelling ramps 507*a, b* relative to a notch 509 that is provided at the point at which the ramps 507*a, b* meet on the upper surface of the part 505. A corresponding protrusion (not shown) is provided on part 511 that can engage with the notch 509 when the handle 503 is aligned parallel to the door 513 so as to hold the handle 503 in place to prevent unintended rotation thereof.

Inside the cap portion 515 of the part 511 of the hinge 501 are provided corresponding internally profiled ramp followers that engage with ramps 507*a, b* in order to provide the rising butt functionality. That is, in use, when handle 503 is turned, the ramps 507*a, b* rotate relative to the part 511, which is fixed to the wall channel portion 517 using arm 519 for example, which includes protrusions to engage into corresponding channels in the wall channel 517 and which can be fixed in place using screws for example.

As will be noted with respect to FIG. 5, the relative orientation of the ramps/ramp followers of the hinge 501 provides a reverse rising butt arrangement in which the door 513 is forced down as the handle is rotated into position parallel to the door.

Figure 6:
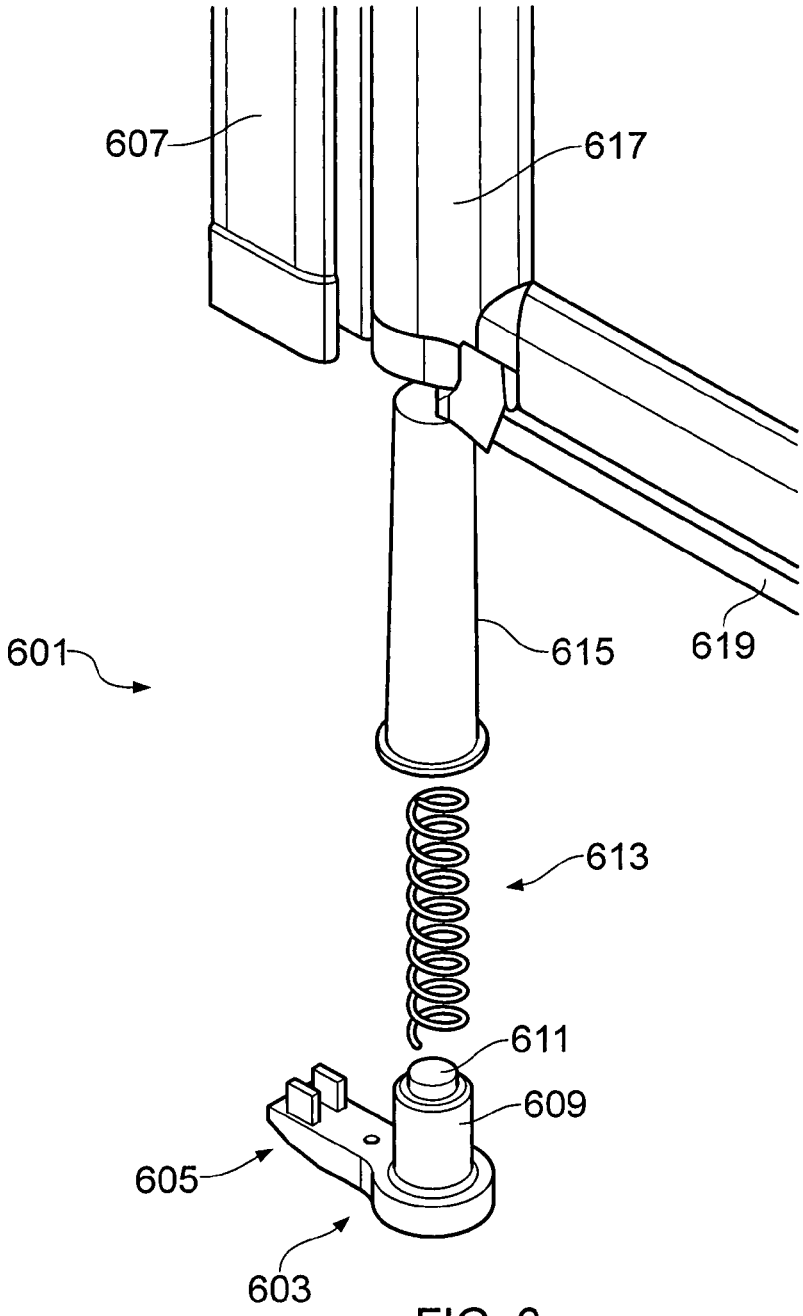
FIG. 6 is an exploded view of a hinge mechanism of a shower door apparatus according to an example.
Figure 8:
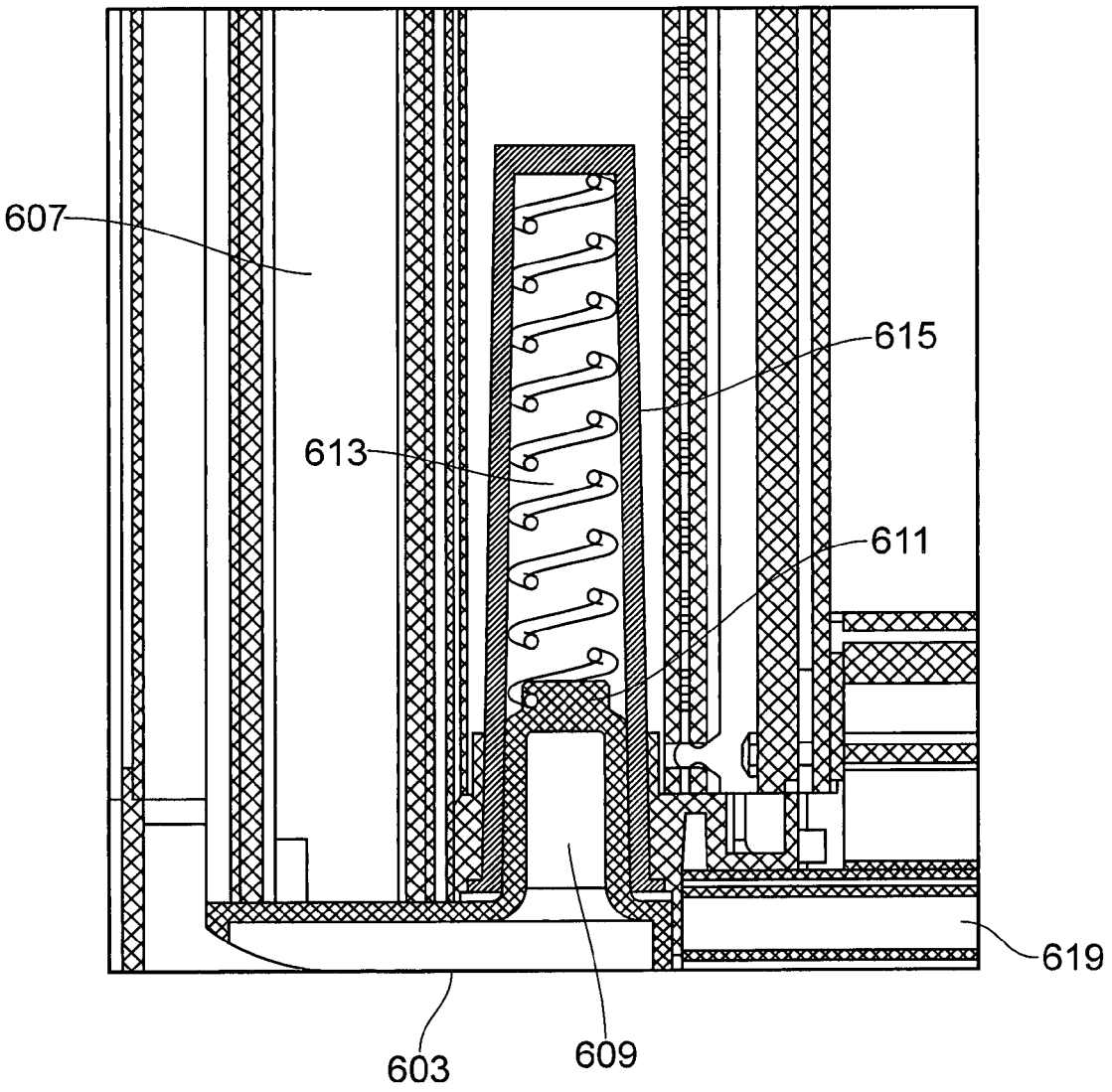
FIG. 8 is a sectional view of a hinge mechanism of a shower door apparatus according to an example.

In this connection, FIG. 6 is an exploded view of a hinge mechanism of a shower door apparatus according to an example. More particularly, a lower hinge 601 of the shower door apparatus of FIG. 5 is shown. Hinge portion 603 includes an arm 605 to engage with, by way of protrusions thereon, wall channel 607. A spring receiving portion 609 is provided on portion 603 in the form of a protrusion. Portion 609 includes an upper portion 611 so profiled as to receive a spring so that spring 613 can rest on portion 609. The spring 613 is contained within a spring retainer portion 615. This retainer portion can rest within part 617 of door 513. Alternatively, as shown in the figure the retainer portion 615 includes an annular rim at the base thereof, which can be fixed between the door moulding and the bottom hinge portion as shown in FIG. 8.

From a position in which the handle 503 is parallel to door 513, the spring is in a compressed state, and the door is biased in an upwards direction. A user can rotate the handle 503 through 90 degrees for example, and in doing so, the central lock position provided by notch 509 and the corresponding protrusion on part 511 can be manually overcome which in turn allows the compressed spring 613 to return to a relaxed position causing the door to rise up in the process of doing so. Accordingly, the action of the spring is such as to cause the door 513 to be lifted up by a predetermined amount, such as 15 mm for example, which allows the bottom seal 619 of the door 513 to become clear of the floor which allows the door to pivot freely thereby eliminating the risk of damage to the bottom seal if dragged over the showering area. A seal can be provided around the base of the retaining portion between it and the portion 603 to prevent ingress of water.

To lower the door, the user rotates the handle through 90 degrees back to the 0 degree position in which the handle is parallel to the door 513. In doing so, the upper hinge portion 501 drives the door downwards compressing the spring 613 within the spring retainer 615, pushing the bottom seal 619 down into the showering area.

As shown in FIG. 5, the mechanism of the top hinge portion 501 includes two reversed rising butt hinge portions 507*a, b* which interact with correspondingly profiled parts in cap 515 to cause the door to be forced downwards when the handle is moved from a 90 degree (open) position to a position in which it is parallel to the door 513 (closed configuration). Due to the handle and the top frame moulding being separate mouldings the screen can be raised or lowered at any desired angle.

Figure 7:
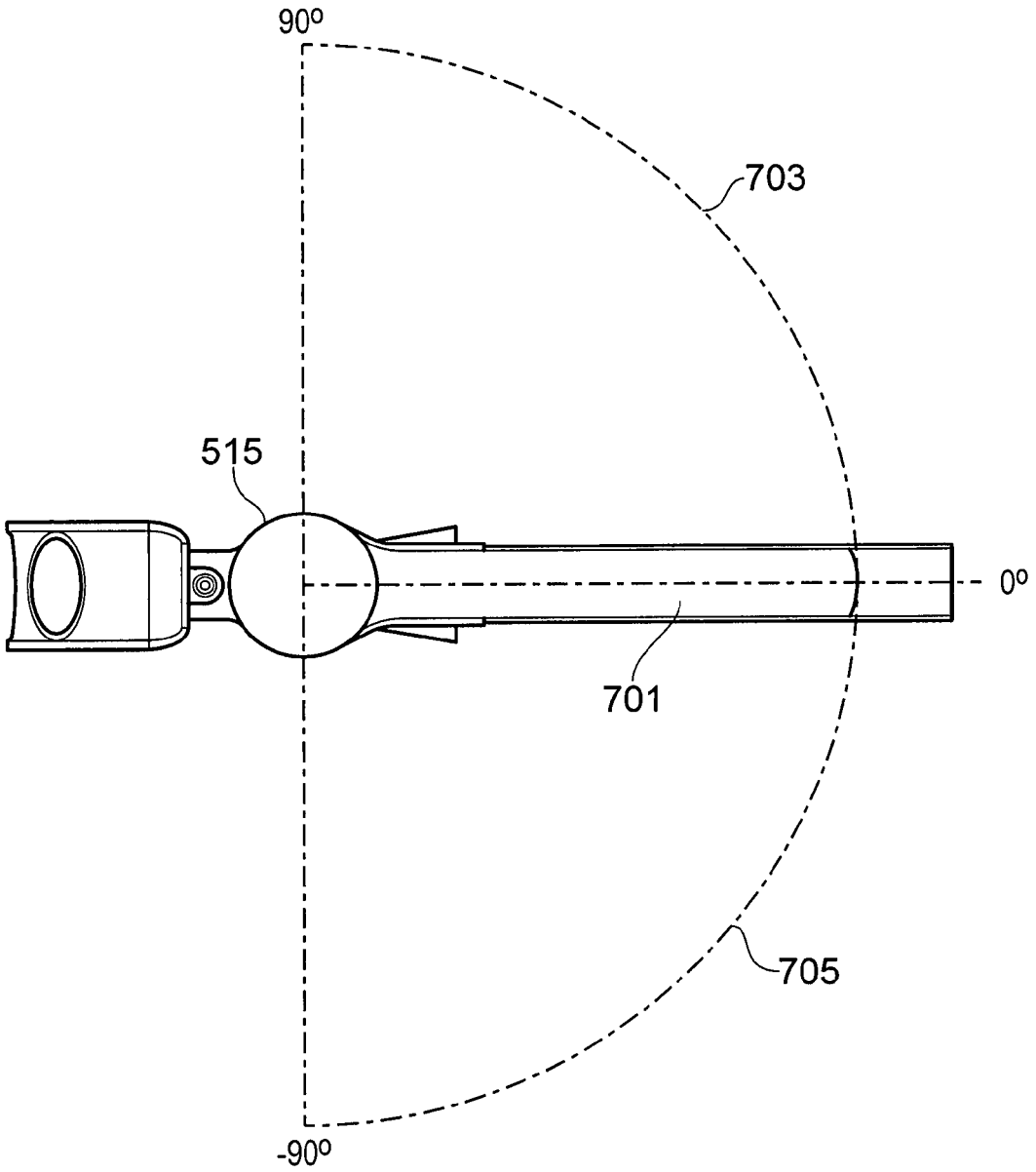
FIG. 7 is a schematic representation of a handle for a shower door apparatus according to an example.

FIG. 7 is a schematic representation of a handle for a shower door apparatus according to an example. FIG. 7 is a plan view of a handle 701 according to example. As depicted by the arcs 703, 705, the handle 701 can be rotated through 90 degrees in either direction from its notional resting position at zero degrees as depicted in which it would be parallel to the direction of the door. FIG. 8 is a sectional view of a hinge mechanism of a shower door apparatus according to an example. More particularly, a sectional view of the hinge portion 601 is depicted. The spring 613 is in a compressed state against portion 611 and within retainer 615 so that the door is in a closed position and seal 619 is against the floor. That is, handle 503 is in a closed position that causes the upper rising butt hinge mechanism to act against the force of the spring 613 to maintain the door in a closed (down) position, and the notch/protrusion combination prevent the handle from rotating of its own accord. Once the handle is rotated in either direction, as shown in FIG. 7 for example, the upper rising butt mechanism of hinge portion 501 enables the spring 613 to decompress thereby causing the door to rise into a position in which the seal 619 is not in contact with the floor.

Figure 9:
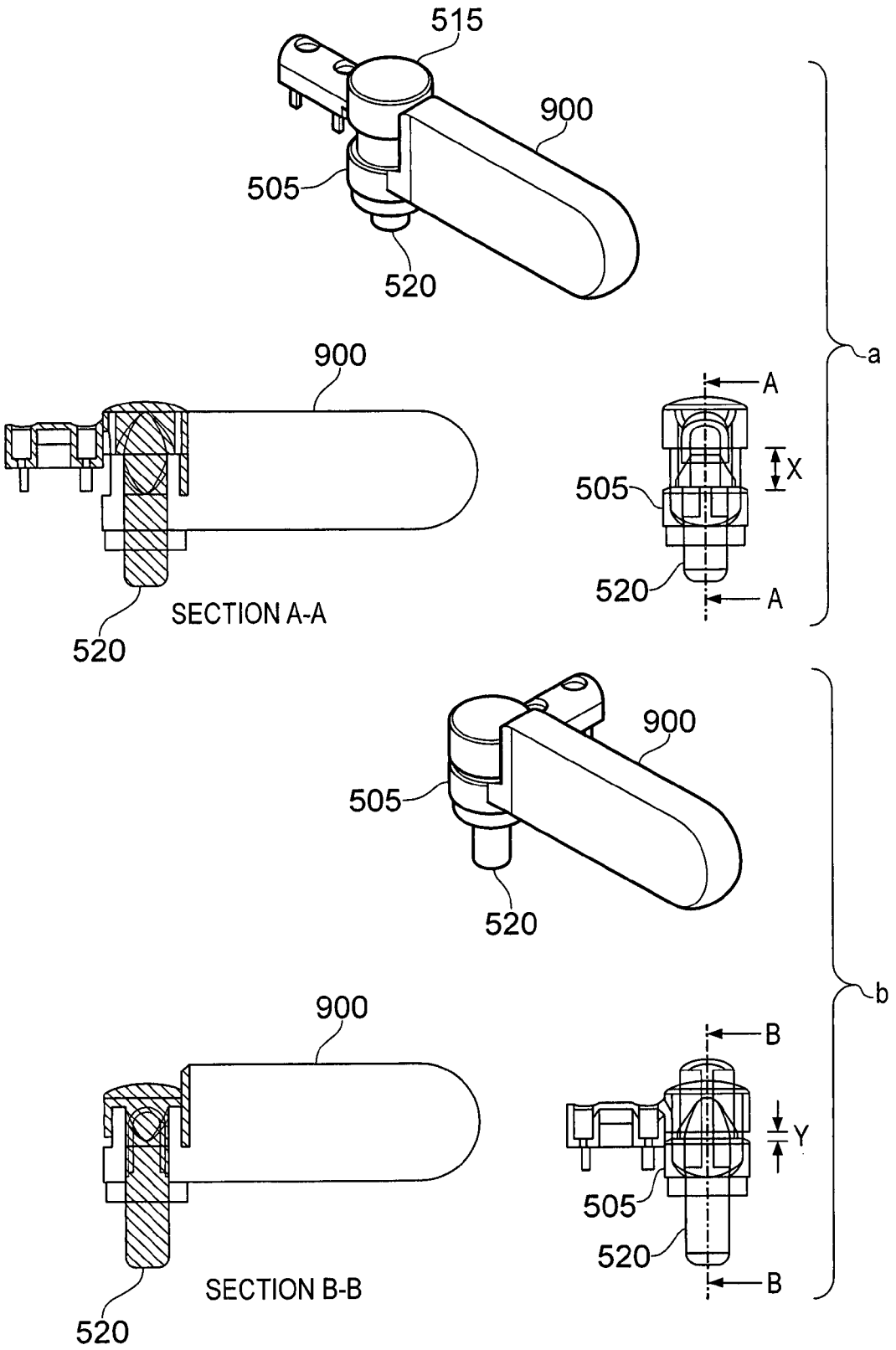
FIG. 9 is a schematic representation of a handle and hinge mechanism for a shower door apparatus according to an example.

FIG. 9 is a schematic representation of a handle and hinge mechanism for a shower door apparatus according to an example. FIG. 9 depicts a handle 900 in a closed position (a), and an open position (b). The internal disposition of the elements of the rising butt hinge mechanism are shown in either case. As can be seen from FIG. 9, in a closed position, the handle portion 900 extends further down the pin 520 of part 511 so that the part 505 of the handle portion is in a position in which it is separated from the bottom of cap 515 by a distance x. Compared with the configuration shown in the bottom half of FIG. 9, in which the handle is in an open position, it can be seen that the separation has been reduced to y, which is smaller than x, thereby enabling the door to rise by virtue of the action of the spring 613.

Figure 10:
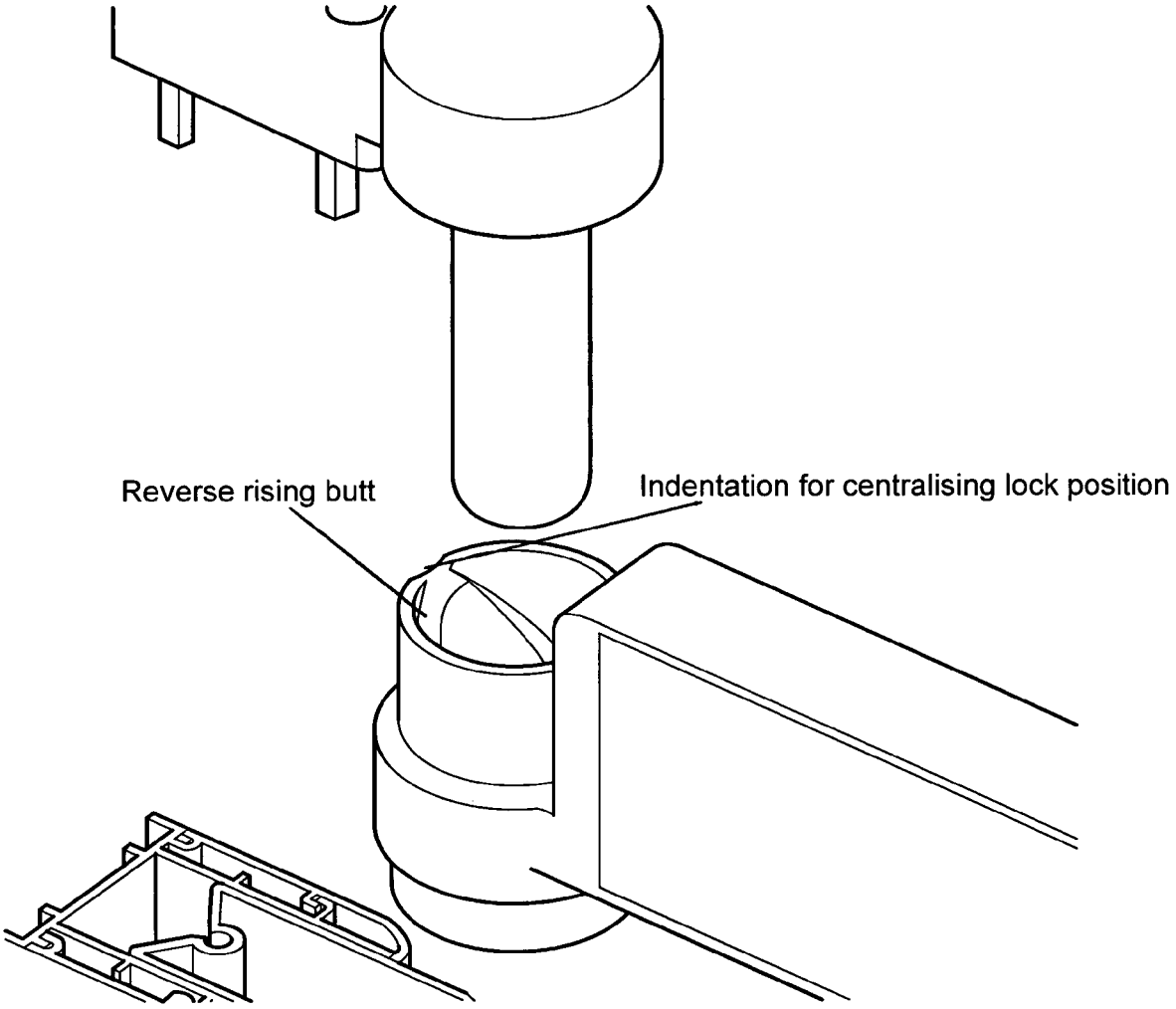
FIG. 10 is an exploded view of a hinge mechanism of a shower door apparatus according to an example.

FIG. 10 is an exploded view of a hinge mechanism of a shower door apparatus according to an example. The view of FIG. 10 shows the reverse rising butt mechanism according to an example in greater detail, as well as the indentation for centralising the lock position of the handle.

The present invention thus provides a hinge mechanism for a shower door, a shower door apparatus comprising the hinge mechanism, and a shower door installation comprising the shower door apparatus. A shower door lifting mechanism is provided that beneficially operates to facilitate opening and closing of the shower door and to reduce damage to the shower door bottom seal as the shower door is opened and closed. Further, a method of enabling a shower door to be lifted to enable rotation of the shower door free of contact with the shower area floor is provided, the method comprising the step of providing the shower door with the shower door hinge mechanism.

The present invention provides a manually-operable lifting hinge mechanism for a shower door. The present invention provides a half-height shower door having upper and lower hinges in which at least the upper hinge comprises a manually-operable lifting hinge mechanism.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A hinge mechanism for a half-height shower door, said hinge mechanism comprising:

an upper hinge mechanism and a lower hinge mechanism, said upper hinge mechanism comprising first and second co-operable hinge parts mountable to the shower door, and a manually-operable element engageable with at least one of said first and second hinge parts of said upper hinge mechanism such that operating said manually-operable element causes one of the first and second hinge parts of said upper hinge mechanism to be moved into a raised or lowered position relative to the other of the first and second hinge parts of said upper hinge mechanism, whereby, in use, operating said manually-operable element causes said shower door to be lifted or lowered, said lower hinge mechanism including a spring element so arranged as to bias the shower door in an upwards direction against the action of the upper hinge mechanism.

2. The hinge mechanism as claimed in claim 1, wherein said second hinge part of the upper hinge mechanism comprises a pin member rotatable within the first hinge part of the upper hinge mechanism, and said manually-operable element comprises a rotatable handle element engageable with the second hinge part of said upper hinge mechanism such that rotating said rotatable handle element rotates said pin member of said second hinge part of said upper hinge mechanism within said first hinge part of said upper hinge mechanism and causes said first hinge part of said upper hinge mechanism to be moved into a raised position relative to said second hinge part of said upper hinge mechanism, whereby, in use, rotating the rotatable handle element causes said shower door to be lifted.

3. The hinge mechanism as claimed in claim 1, wherein the first and second hinge parts of the upper hinge mechanism form a rising butt hinge mechanism.

4. The hinge mechanism as claimed in claim 3, wherein the first and second hinge parts of the upper hinge mechanism comprise respective ramped or inclined portions so configured as to cause relative translational movement between the first and second hinge parts upon rotation of one of the first and second hinge parts.

5. The hinge mechanism as claimed in claim 1, wherein the first and second hinge parts include a cooperating notch and protrusion respectively, whereby to cause the handle to hold in a closed configuration when the notch and protrusion are brought together so that the protrusion rests in the notch.

6. A shower door apparatus comprising:

a shower door provided with a bottom seal element; and a hinge mechanism, said hinge mechanism comprising:

an upper hinge mechanism and a lower hinge mechanism, said upper hinge mechanism comprising first and second co-operable hinge parts mountable to the shower door, and a manually-operable element engageable with at least one of said first and second hinge parts of said upper hinge mechanism such that operating said manually-operable element causes one of the first and second hinge parts of said upper hinge mechanism to be moved into a raised or lowered position relative to the other of the first and second hinge parts of said upper hinge mechanism, whereby, in use, operating said manually-operable element causes said shower door to be lifted or lowered, said lower hinge mechanism including a spring element so arranged as to bias the door apparatus in an upwards direction against the action of the upper hinge mechanism.

7. The shower door apparatus as claimed in claim 6, wherein said shower door is a half-height shower door provided with upper and lower pivot hinges, and said upper pivot hinge is provided by said hinge mechanism.

8. The shower door apparatus as claimed in claim 6, further comprising door rotation inhibiting means for inhibiting rotation of the shower door during operation of said manually-operable element.

9. The shower door apparatus as claimed in claim 8, wherein said door rotation inhibiting means comprises a seal member between an inside edge of the shower door and a support member.

10. The shower door apparatus as claimed in claim 6, further comprising shower door position indicating means for indicating whether the shower door is in a lowered position or in a raised position.

11. The shower door apparatus as claimed in claim 6, wherein said second hinge part of the upper hinge mechanism comprises a pin member rotatable within the first hinge part of the upper hinge mechanism, said manually-operable element comprises a rotatable handle element engageable with the second hinge part of said upper hinge mechanism such that rotating said rotatable handle element rotates said pin member of said second hinge part of said upper hinge mechanism within said first hinge part of said upper hinge mechanism and causes said first hinge part of said upper hinge mechanism to be moved into a raised position relative to said second hinge part of said upper hinge mechanism, whereby, in use, rotating the rotatable handle element causes said shower door to be lifted, the rotatable handle element comprises an elongate grippable portion, and said upper hinge mechanism is arranged such that, when the shower door is closed, the elongate grippable portion of the rotatable handle element extends in one of: substantially the same direction as the shower door, substantially perpendicularly to the direction of the shower door.

12. The shower door apparatus as claimed in claim 11, wherein said rotatable handle element is rotatable through a maximum travel of approximately 90 degrees rotation.

13. The shower door apparatus as claimed in claim 6, wherein said upper hinge mechanism is operable to raise the shower door approximately 10 mm.

14. The shower door apparatus as claimed in claim 6, wherein the shower door comprises a frame element that supports a shower door panel.

15. The shower door apparatus as claimed in claim 14, wherein said shower door panel is fabricated from one of: a glass material, a plastics material.

16. The shower door apparatus as claimed in claim 6, wherein the upper hinge mechanism is a rising butt hinge mechanism operable, upon rotation of a handle from a closed to an open configuration, to cause the door apparatus to move in a downwards direction against the action of the spring element.

* * * * *